US006732645B2

(12) United States Patent
Yamamoto et al.

(10) Patent No.: US 6,732,645 B2
(45) Date of Patent: May 11, 2004

(54) METHOD OF PRESETTING INK

(75) Inventors: Takaharu Yamamoto, Kyoto (JP); Shigeo Murakami, Kyoto (JP); Nobuhito Kohara, Kyoto (JP); Kuniharu Okuda, Kyoto (JP)

(73) Assignee: Dainippon Screen MFG., Co., Ltd., Kyoto (JP)

( * ) Notice: Subject to any disclaimer, the term of this patent is extended or adjusted under 35 U.S.C. 154(b) by 0 days.

(21) Appl. No.: 10/265,681

(22) Filed: Oct. 8, 2002

(65) Prior Publication Data

US 2003/0066447 A1 Apr. 10, 2003

(30) Foreign Application Priority Data

Oct. 10, 2001 (JP) ..... P2001-312869

(51) Int. Cl.[7] ..... B41F 31/02; B41F 31/00; B41F 1/54; B41J 2/315; B41J 11/42

(52) U.S. Cl. ..... 101/365; 101/335; 101/484; 101/232; 101/350.4; 101/483; 101/416.1; 101/492; 101/425; 400/120.09; 400/582

(58) Field of Search ..... 101/365, 335, 101/484, 232, 233, 350.4, 483, 416.1, 425, 492; 400/120.09, 582; 358/1.4, 1.9

(56) References Cited

U.S. PATENT DOCUMENTS

| | | | | | |
|---|---|---|---|---|---|
| 3,567,923 | A | * | 3/1971 | Hutchison | 101/484 |
| 3,835,777 | A | * | 9/1974 | Krygeris | 101/350.4 |
| 4,901,254 | A | * | 2/1990 | Dolezalek et al. | 356/405 |
| 5,126,754 | A | * | 6/1992 | Spinar et al. | 346/29 |
| 5,148,747 | A | * | 9/1992 | Rodi et al. | 101/450.1 |
| 5,182,721 | A | | 1/1993 | Kipphan et al. | 382/112 |
| 5,447,102 | A | * | 9/1995 | Pfeiffer et al. | 101/492 |
| RE35,495 | E | | 4/1997 | Bolza-Schuenemann et al. | 101/232 |
| 5,724,437 | A | * | 3/1998 | Bucher et al. | 382/112 |
| 5,806,429 | A | * | 9/1998 | Laubmann | 101/365 |
| 5,841,955 | A | * | 11/1998 | Wang | 358/1.9 |
| 5,870,529 | A | * | 2/1999 | Kistler et al. | 358/1.4 |
| 5,884,562 | A | * | 3/1999 | Sugiyama et al. | 101/484 |
| 5,907,999 | A | * | 6/1999 | Lusar, deceased et al. | 101/484 |
| 5,921,184 | A | * | 7/1999 | Sugiyama et al. | 101/484 |
| 5,957,054 | A | * | 9/1999 | Olawsky et al. | 101/483 |
| 5,967,049 | A | * | 10/1999 | Seymour et al. | 101/484 |
| 6,041,708 | A | | 3/2000 | Kipphan et al. | 101/365 |
| 6,119,594 | A | * | 9/2000 | Kipphan et al. | 101/365 |
| 6,213,019 | B1 | * | 4/2001 | Muller | 101/484 |
| 6,318,260 | B1 | * | 11/2001 | Chu et al. | 101/365 |
| 6,367,380 | B1 | * | 4/2002 | Whelan | 101/350.4 |
| 6,446,555 | B1 | * | 9/2002 | Schramm et al. | 101/365 |
| 6,491,458 | B2 | * | 12/2002 | Hori et al. | 400/582 |
| 6,499,402 | B1 | * | 12/2002 | Sikes et al. | 101/484 |
| 6,533,383 | B1 | * | 3/2003 | Saruta et al. | 347/19 |
| 6,536,341 | B2 | * | 3/2003 | Shiki et al. | 101/365 |
| 6,539,863 | B2 | * | 4/2003 | Shiraishi | 101/365 |

FOREIGN PATENT DOCUMENTS

| | | |
|---|---|---|
| JP | 10-16193 | 1/1998 |
| JP | 2824334 | 9/1998 |
| JP | 11-91075 | 4/1999 |
| JP | 2000-255035 | 9/2000 |
| JP | 2001-1500 | 1/2001 |
| JP | 2001-246733 | 9/2001 |
| JP | 2001-253054 | 9/2001 |

* cited by examiner

*Primary Examiner*—Andrew H. Hirshfeld
*Assistant Examiner*—Wasseem Hamdan
(74) *Attorney, Agent, or Firm*—McDermott, Will & Emery

(57) ABSTRACT

In a first printing process in Steps S1 through S6, ink supply is controlled so that a measured printed density (Vn) is approximately equal to a first target density (V1). This provides a uniform amount of ink remaining on ink rollers after the first printing process. Thereafter, in a second printing process in Steps S7 through S11, printing is performed using a second target density (V2) lower than the first target density (V1). This provides a slightly reduced, uniform amount of ink remaining on the ink rollers. Thus, a novel method of presetting ink is provided which facilitates the formation of a distribution of the new amount of ink at the beginning of the next printing operation and which stabilizes the early start of printing.

10 Claims, 12 Drawing Sheets

METHOD OF PRESETTING INK

BACKGROUND OF THE INVENTION

1. Field of the Invention

The present invention relates to an ink presetting method which adjusts the amount of ink remaining on ink rollers before the next printing operation in an apparatus for offset printing.

2. Description of the Background Art

A typical offset printing apparatus includes a plurality of ink duct (or ink fountain) devices having ink keys, and is capable of supplying variable amounts of ink in a direction crosswise to a predetermined feed direction of a paper sheet to be printed. This controls a distribution of the amount of ink depending on the area of an image on a printing plate in such a manner that an increased amount of ink is supplied to a region having a large image area or consuming much ink whereas a reduced amount of ink is supplied to a region having a small image area or consuming less ink.

In printing operations, it is general to replace printing plates after one printing operation to perform the next printing operation. In this case, there arises a need to readjust the amount of ink supply for each printing operation because of a difference in image to be printed on paper sheets between the preceding and current printing operations.

Unfortunately, the amount of ink remaining on ink rollers after the preceding printing operation is often non-uniform based on the distribution of the image area in the preceding printing operation. It is hence difficult to make a change to a new ink amount distribution in a short time at the beginning of the next printing operation. This consumes a large amount of spoilage (or many waste paper sheets) before the stabilization of the quality of the printed sheets at the beginning of the next printing operation, and thus requires much time.

A solution to the above-mentioned problem includes a known technique disclosed, for example, in Japanese Patent Application Laid-Open No. 10-16193 (1998). In this background art technique, printing is performed with the supply of ink suspended to reduce the ink remaining on the ink rollers to a minimum required amount. That is, this technique transfers ink to the paper sheets to eliminate the irregularities of the distribution of the amount of ink on the ink rollers resulting from the preceding printing operation to provide a uniform distribution. Then, new ink is supplied before the next printing operation, and ink presetting is completed.

This background art technique is effective to provide uniformity of the amount of ink distributed on the ink rollers, but is disadvantageous in requiring waste paper sheets (or spoilage) to be used until the removal of ink. In particular, if an image having a relatively low density in one printing operation follows an image having a relatively high density in its preceding printing operation, a large amount of ink has been supplied onto the ink rollers in the preceding printing operation. This necessitates a large amount of ink to be removed, to require relatively large amounts of time and spoilage for completion of ink presetting.

SUMMARY OF THE INVENTION

The present invention is intended for a method of presetting ink in a printing apparatus, the apparatus comprising an ink supply mechanism capable of variably supplying ink, and an ink transfer mechanism capable of receiving the ink from the ink supply mechanism and transferring the ink onto a plate cylinder provided to print an ink image on a printing sheet being fed in a predetermined feeding direction.

According to the present invention, the method comprises the steps of: a) setting a first target density for a plurality of ink key regions defined on each printing sheet along the feeding direction; b) performing a first printing operation under a first feedback control of the ink supply mechanism using the first target density; c) performing a second printing operation under a second feedback control of the ink supply mechanism using a second target density lower than the first target density after a required number of sheets are printed in the step b); and d) when a printed sheet has a density lowered to the second target density, judging that the amount of ink remaining on the ink transfer mechanism is equal to an amount required to restart the printing apparatus for a next printing operation, thereby to stop the second printing operation.

This provides the uniform printed density to provide a substantially uniform amount of ink remaining on the ink rollers, thereby facilitating the start of the next printing operation. In particular, when reducing the amount of ink on the ink rollers by transferring ink to a printing plate surface and a blanket plate, there is produced an additional effect of eliminating the need for spoilage for adjustment of the amount of ink.

Preferably, the respective densities on the plurality of ink key regions are measured with a density detector provided in the printing apparatus.

Preferably, the respective ink keys of are adjusted so that the second values of measured density are within a ±0.2 range around the second target density in the step c).

The present invention is also intended for a method of presetting ink in a printing apparatus, the apparatus comprising an ink supply mechanism capable of variably supplying ink, and an ink transfer mechanism capable of receiving the ink from the ink supply mechanism and transferring the ink onto a plate cylinder provided to print an ink image on a printing sheet being fed in a predetermined feeding direction. According to the present invention, the method comprises the steps of: a) setting a target density for a plurality of ink key regions defined on each printing sheet along the feeding direction; b) performing a printing operation under a feedback control of the ink supply mechanism using the target density; c) changing the printing apparatus to the intermediate state where transfer of the ink from the ink supply mechanism to the ink transfer mechanism is stopped and the printing operation is also stopped; d) transferring residual ink on the ink transfer mechanism to the plate cylinder in the intermediate state; and e) stopping the printing apparatus.

It is therefore an object of the present invention to provide a novel method of presetting ink which previously eliminates the irregularities of a distribution of the amount of ink on ink rollers.

These and other objects, features, aspects and advantages of the present invention will become more apparent from the following detailed description of the present invention when taken in conjunction with the accompanying drawings.

DESCRIPTION OF THE PREFERRED EMBODIMENTS

<Description of Printing Apparatus>

Figure 1A:
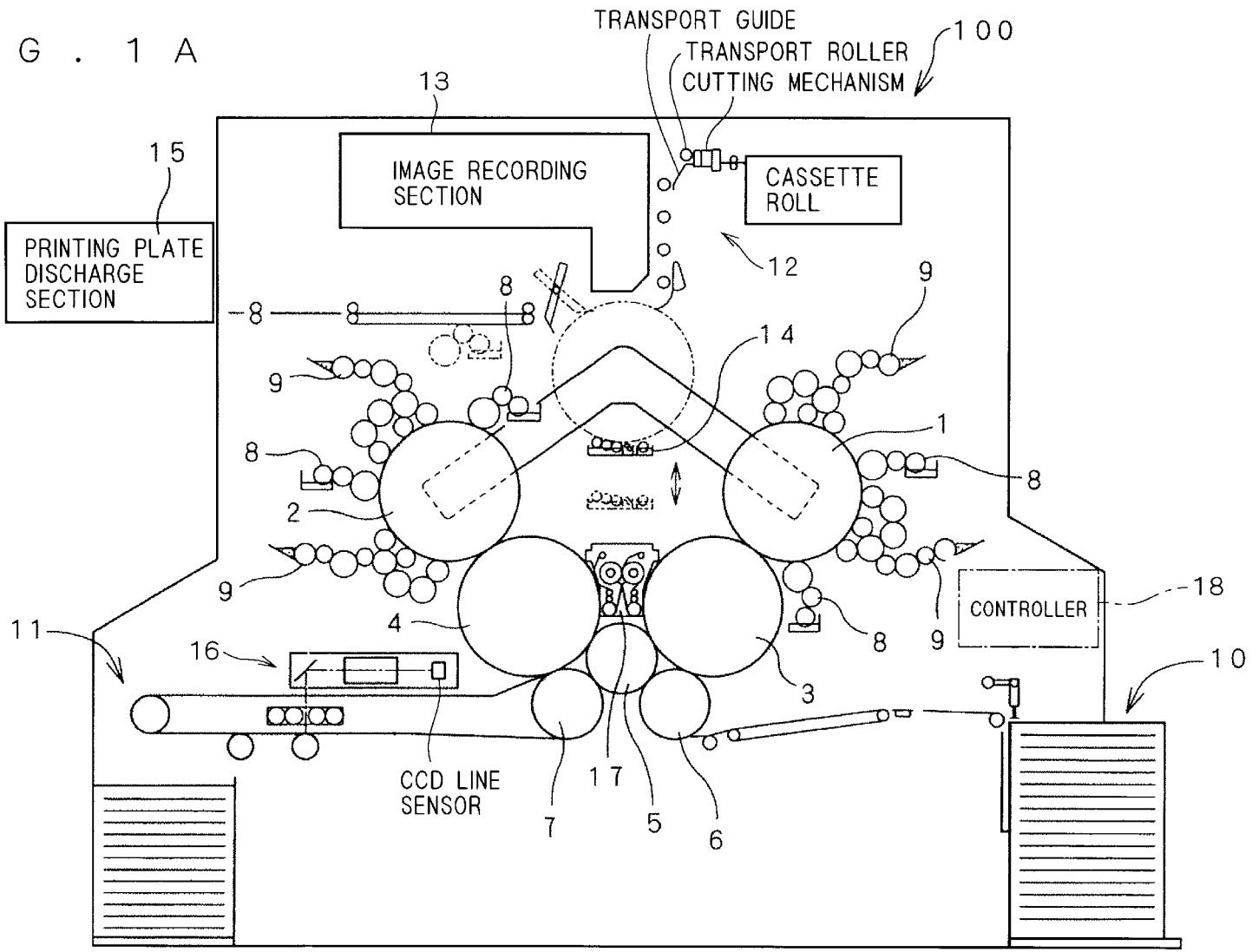
FIG. 1A is a schematic view of an exemplary printing apparatus capable of carrying out a method of presetting ink according to preferred embodiments of the present invention.

A printing apparatus 100 according to a first preferred embodiment of the present invention will now be described with reference to the drawings. FIG. 1A is a schematic view of an example of the printing apparatus 100 for carrying out a method of presetting ink according to the first preferred embodiment. Referring first to FIG. 1A, the printing apparatus 100 comprises, as a printing mechanism: first and second plate cylinders 1 and 2 for holding printing plates; first and second blanket cylinders 3 and 4 for transfer of an ink image from the respective plate cylinders 1 and 2 thereto; an impression cylinder 5 for holding a paper sheet (or a printing medium) to be printed to which the ink image is transferred from the blanket cylinders 3 and 4; a paper feed cylinder 6 and a paper discharge cylinder 7 for feeding and discharging the sheet to and from the impression cylinder 5; dampening water supply mechanisms 8 and ink supply mechanisms 9 for supplying dampening water and ink, respectively, to the printing plates on the first and second plate cylinders 1 and 2; a paper feed section 10 for sequentially feeding unprinted paper sheets arranged in a stacked relation; and a paper discharge section 11 for sequentially receiving printed paper sheets to form a stack.

As a prepress (or plate making) mechanism, the printing apparatus 100 comprises: a printing plate supply section 12 for supplying unexposed printing plates to the first and second plate cylinders 1 and 2; an image recording section 13 for recording an image on the printing plates held on the plate cylinders 1 and 2; a development section 14 for developing the printing plates with the image recorded thereon; and a printing plate discharge section 15 for discharging used printing plates.

The printing apparatus 100 further comprises an image reader 16 for capturing an image on the printed sheet to measure an image density; a cleaning device 17 for cleaning the blanket cylinders 3 and 4; and a controller 18 for controlling the overall printing apparatus 100.

The parts of the printing apparatus 100 will be described in detail. The first plate cylinder 1 is movable by a plate cylinder drive mechanism not shown between a first printing position shown by a solid line in FIG. 1A and an image recording position shown by a dash-double dot line. Likewise, the second plate cylinder 2 is movable by a plate cylinder drive mechanism not shown between a second printing position shown by a solid line in FIG. 1A and the image recording position shown by the dash-double dot line. Specifically, the first and second plate cylinders 1 and 2 are in the first and second printing positions, respectively, when a printing operation is performed, and are alternately located in the image recording position when a prepress (or plate making) operation is performed on the printing plates held on the plate cylinders 1 and 2. Each of the first and second plate cylinders 1 and 2 has a peripheral surface capable of holding thereon two printing plates for two respective colors, and includes a pair of gripping mechanisms for fixing the printing plates, respectively, in circumferentially opposed positions 180 degrees apart from each other on the peripheral surface.

The first blanket cylinder 3 is adapted to rotate in contact with the first plate cylinder 1 in the first printing position. Likewise, the second blanket cylinder 4 is adapted to rotate in contact with the second plate cylinder 2 in the second printing position. The first and second blanket cylinders 3 and 4 are approximately equal in diameter to the first and second plate cylinders 1 and 2, and have a blanket mounted on their peripheral surface for transfer of ink images of two colors from each of the plate cylinders 1 and 2.

The impression cylinder 5 has a diameter approximately one-half the diameter of the first and second plate cylinders 1 and 2, and is adapted to rotate in contact with both of the first and second blanket cylinders 3 and 4. The impression cylinder 5 includes a gripping mechanism capable of holding the single sheet having a size corresponding to that of the printing plate. The gripping mechanism is opened and closed in predetermined timed relation by an opening/closing mechanism not shown to grip a leading end of the sheet.

The paper feed cylinder 6 and the paper discharge cylinder 7 are approximately equal in diameter to the impression cylinder 5, and each includes a gripping mechanism (not shown) similar to that of the impression cylinder 5. The gripping mechanism of the paper feed cylinder 6 is positioned to pass the sheet in synchronism with the gripping mechanism of the impression cylinder 5, and the gripping mechanism of the paper discharge cylinder 7 is positioned to receive the sheet in synchronism with the gripping mechanism of the impression cylinder 5.

The first and second plate cylinders 1 and 2 in the first and second printing positions, the first and second blanket cylinders 3 and 4, the impression cylinder 5, the paper feed cylinder 6 and the paper discharge cylinder 7 are driven by a printing driving motor not shown to rotate in synchronism with each other. In the printing apparatus 100, since the plate cylinders 1 and 2 and the blanket cylinders 3 and 4 have a circumference approximately twice greater than that of the impression cylinder 5, the impression cylinder 5 rotates two turns each time the plate cylinders 1 and 2 and the blanket cylinders 3 and 4 rotate one turn. Thus, two turns of the impression cylinder 5 with the sheet held thereon effect multicolor printing using two colors from the first plate cylinder 1 and two colors from the second plate cylinder 2 or a total of four colors.

Two dampening water supply mechanisms 8 are provided for each of the plate cylinders 1 and 2 in the first and second printing positions, and are capable of selectively supplying the dampening water to the two printing plates on each of the plate cylinders 1 and 2. Each of the dampening water supply mechanisms 8 includes a water fountain for storing the dampening water, and a set of dampening water rollers for drawing up the dampening water from the water fountain to pass the dampening water to a printing plate surface. At least some of the set of dampening water rollers which contact the printing plate surface are brought into and out of contact with a plate cylinder surface by a cam mechanism. The dampening water supply mechanisms 8 need not be provided if the printing plates are of the type which requires no dampening water.

Figure 1B:
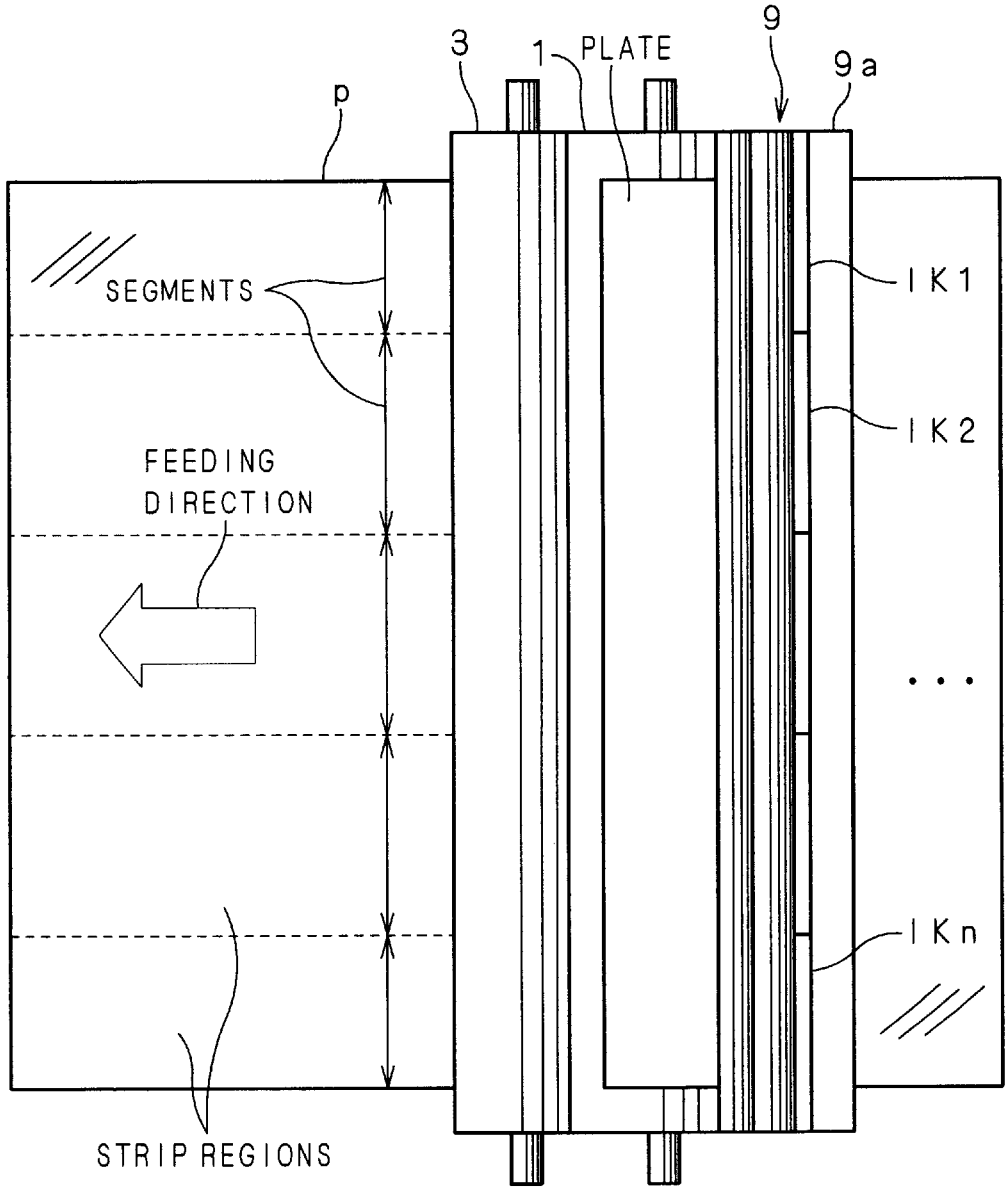
FIG. 1B is a schematic plan view illustrating transfer of ink from an ink supply mechanism to a print sheet.

Two ink supply mechanisms 9 are provided for each of the plate cylinders 1 and 2 in the first and second printing positions, and are capable of selectively supplying inks of different colors to the two printing plates on each of the plate cylinders 1 and 2. As illustrated in FIG. 1B, each of the ink supply mechanisms 9 includes an ink duct or ink fountain 9*a* capable of adjusting the amount of ink supply for each strip region extending in a predetermined feed direction (or forward direction) of the paper sheet p, and supplies the ink from the ink ducts through a plurality of ink rollers onto the printing plate surface on each of the plate cylinders 1 and 2. At least some of the ink rollers which contact the printing plate surface are brought into and out of contact with the plate cylinder surface by a cam mechanism. The ink duct 9*a* is provided with a plurality of ink keys IK1, IK2 . . . IKn. Respective amounts of ink supplied to a linear array of segments defined across the feeding direction on the print paper p are independently adjusted by respective ink keys IK1, IK2 . . . IKn, whereby the ink density on respective strip regions on the print paper p are controlled. Only the part including the plate cylinder 1 and the blanket cylinder 2 is illustrated in FIG. 1B, and that including the plate cylinder 3 and the blanket cylinder 4 in FIG. 1A has a similar configuration.

The inks in the ink supply mechanisms 9 are, for example, such that the ink supply mechanisms 9 for K (black) and M (magenta) colors are provided for the first plate cylinder 1, and the ink supply mechanisms 9 for C (cyan) and Y (yellow) colors are provided for the second plate cylinder 2. At least some of the dampening water supply mechanisms 8 and ink supply mechanisms 9 which lie on the paths of movement of the first and second plate cylinders 1 and 2 are adapted to be shunted out of the paths of movement as the first and second plate cylinders 1 and 2 move.

The paper feed section 10 feeds paper sheets, one at a time, from a stack of unprinted paper sheets to the paper feed cylinder 6. In this preferred embodiment, the paper feed section 10 operates so that one paper sheet is fed each time the paper feed cylinder 6 rotates two turns. The paper discharge section 11 receives printed paper sheets from the paper discharge cylinder 7 to form a stack. The paper discharge section 11 includes a known chain transport mechanism for discharging and carrying a printed paper sheet, with the leading end of the printed paper sheet gripped by a gripper (or gripper finger) carried around by a chain. The image reader 16 is provided at some midpoint in the path of movement of the printed sheets discharged by the paper discharge section 11.

Next, the prepress mechanism of the printing apparatus 100 will be described. In the printing apparatus 100, the first and second plate cylinders 1 and 2 are alternately moved to the image recording position during the execution of the prepress operation. In this image recording position, a friction roller not shown is driven to rotate in contact with the plate cylinder 1 or 2.

The printing plate supply section 12 includes a cassette roll for storing a roll of unexposed printing plate while shielding the roll of unexposed printing plate from light, a transport roller and a transport guide for transporting the printing plate unwound from the cassette roll to the plate cylinder 1 or 2, and a cutting mechanism for cutting the printing plate into sheet form. In this preferred embodiment, a silver halide sensitive material is used for the printing plate, and laser light is used to record an image on the printing plate. The procedure of a printing plate supply operation includes: causing one of the gripping mechanisms not shown of the plate cylinder 1 or 2 to grip the leading end of the printing plate unwound from the cassette roll; rotating the plate cylinder 1 or 2 in this condition to wind the printing plate around the plate cylinder 1 or 2; then cutting the printing plate to length; and causing the other gripping mechanism to grip the trailing end of the printing plate.

The image recording section 13 turns on/off laser light to expose a printing plate to the light, thereby recording an image on the printing plate. In the first preferred embodiment, the controller 18 determines the position of the image on the printing plate, and sends corresponding image data to the image recording section 13. The image recording section 13 effects main scanning with the laser light emitted from a laser source in the axial direction of the plate cylinder 1 or 2 by using a polarizer such as a polygon mirror, while effecting sub-scanning over the printing plate surface by rotating the plate cylinder 1 or 2. The method of scanning may be of the type such that a plurality of laser sources are arranged in the axial direction of a plate cylinder and main scanning is carried out with a plurality of laser beams emitted from the respective laser sources as the plate cylinder rotates. The printing plate and the image recording section 13 are not limited to those of the type such that an image is recorded by exposure to light, but may be of the type such that an image is thermally or otherwise recorded.

The development section 14 develops the printing plate exposed by the image recording section 13. In this preferred embodiment, the development section 14 draws up a processing solution stored in a processing bath by using a coating roller to apply the processing solution to the printing plate, thereby developing the printing plate. The development section 14 includes an elevating mechanism for moving between a position in which the development section 14 is shunted from the plate cylinder 1 or 2 and a position in which the development section 14 is closer to the plate cylinder 1 or 2. The development section 14 itself need not be provided if an image recording method which requires no development is employed.

In the printing apparatus 100, the first and second plate cylinders 1 and 2 are moved to the image recording position, in which the prepress operation is performed by supplying the printing plate and then recording and developing an image. After the prepress operation is completed, the first and second plate cylinders 1 and 2 are moved to the first and second printing positions, respectively, for the printing process.

The printing apparatus 100 is capable of automatically discharging the printing plate after the printing operation is completed. In this preferred embodiment, the printing plate discharge section 15 includes a peeling section for peeling the printing plate from the first or second plate cylinder 1 or 2 in the image recording position, a transport mechanism for transporting the peeled printing plate, and a discharge cassette for discharging the used printing plate so transported.

The image reader 16 includes a CCD line sensor for capturing images on a printed paper sheet being discharged sequentially on a line by line basis to obtain desired image data. In the first preferred embodiment, the controller 18 converts the RGB image data obtained by the image reader 16 into CMYK image density values, thereby to measure a printed density on the printed paper sheet. For example, a plurality of color chart images arranged in a direction crosswise to the predetermined feed direction are formed on a printing plate in the first preferred embodiment. Since each of the color chart images includes solid patch images provided in each ink key region, solid patches of four colors of YMCK are printed in each ink key region of the paper sheet. Therefore, the printed density is measured for each ink key region by capturing the solid patch images and measuring the corresponding printed densities. The printed density as used herein refers to an optical reflectance density, for each of the RGB colors, which is measured by the use of a predetermined filter. For each of the YMCK colors, a target printed density to provide a standard printed color on a printed sheet is specified based on the reflectance density of the 100% dense solid patch of each ink. (The standard value thereof in Japan is specified as Japan color.)

The cleaning device 17 comes in contact with the blanket cylinders 3 and 4 to clean the cylinder surfaces. In this preferred embodiment, individual cleaning devices are provided respectively for the blanket cylinders 3 and 4. The cleaning device 17 includes a cleaning solution supply mechanism, and a wiping mechanism using a cleaning cloth (or wiper).

The controller 18 is a microcomputer system including various input/output sections and storage sections, and is contained in the printing apparatus 100. The controller 18 controls the overall printing apparatus 100, based on a predetermined program operation. The controller 18 also functions as a computation device for performing a computing process upon an image read by the image reader 16.

Figure 2:
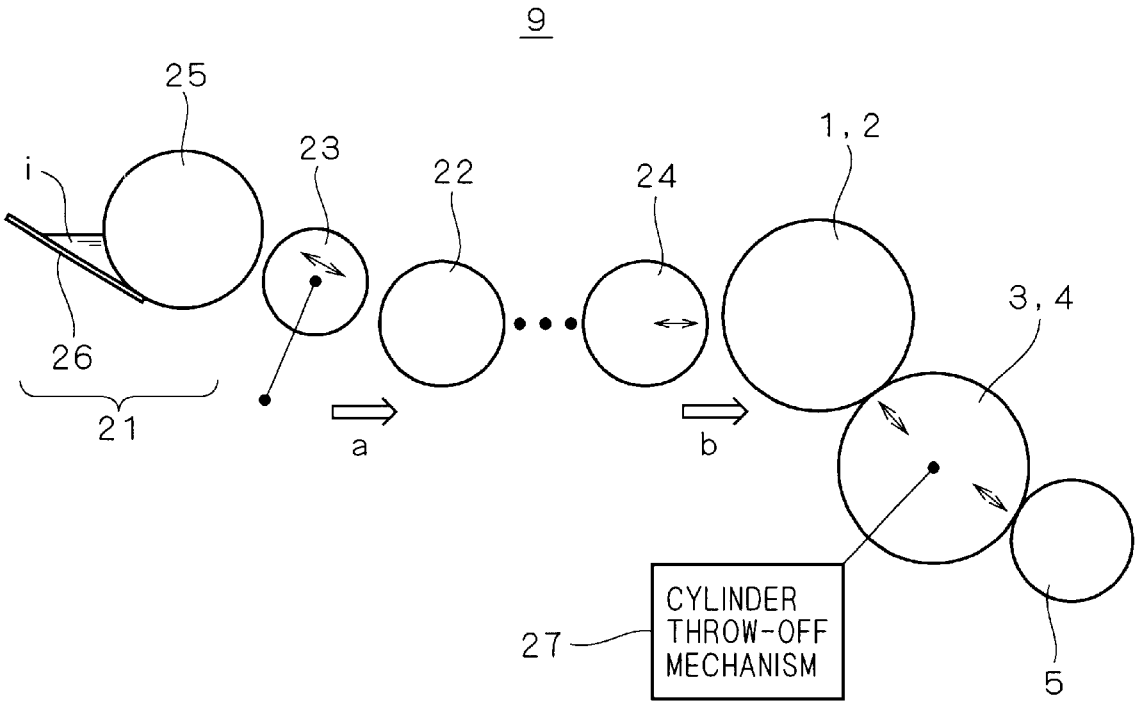
FIG. 2 is a schematic view of an ink supply mechanism and an ink transfer path.

Next, the detailed construction of each of the ink supply mechanisms 9 and the principle of the method of presetting the amount of ink will be described according to the present invention. FIG. 2 is a schematic view of a path of transfer of ink from the ink supply mechanism 9 to the paper sheet. Referring to FIG. 2, the ink supply mechanism 9 comprises an ink duct or ink fountain 21, an ink ductor roller or vibrating roller 23 for transferring ink from the ink duct 21 to downstream ink rollers 22, and a form roller 24 for applying the ink transferred from the ink rollers 22 onto a printing plate surface held on the plate cylinders 1 and 2.

The ink duct 21 includes a rotatable ink fountain roller 25, and ink keys 26 closely spaced apart from the ink fountain roller 25. An ink pool i is formed in an ink well surrounded by the ink fountain roller 25, the ink keys 26 and side plates not shown. In the ink duct 21, the plurality of separate ink keys 26 are arranged in the axial direction of the ink fountain roller 25, and are independently adapted so that a spacing (referred to hereinafter as an opening of an ink key) between each of the ink keys 26 and the peripheral surface of the ink fountain roller 25 is adjustable. As the ink fountain roller 25 in this state rotates in a counterclockwise direction, an ink film of a desired thickness is formed on the surface of the ink fountain roller 25 in accordance with the openings of the ink keys 26. Regions of a paper sheet corresponding to the respective ink keys 26 are referred to hereinafter as ink key regions.

The ink rollers 22 (although the single ink roller 22 is shown in FIG. 2) are made of metal or rubber, and are arranged in successively contacting relationship to sequentially transfer ink. The ink ductor roller 23 moves in a reciprocating manner between the ink fountain roller 25 and the shown ink roller 22 so as to alternately contact the ink fountain roller 25 and the shown ink roller 22. That is, the reciprocating movement of the ink ductor roller 23 transfers the ink on the ink fountain roller 25 to the ink rollers 22. The number of times the ink ductor roller 23 makes the reciprocating movement is referred to hereinafter as an ink supply count.

The form roller 24 transfers the ink distributed by the ink rollers 22 onto a printing plate surface. In the first preferred embodiment, the form roller 24 is moved toward and away from the plate cylinders 1 and 2 by a cam mechanism so as to come into contact with only a corresponding printing plate. The ink rollers 22, the ink ductor roller 23 and the form roller 24 are collectively referred to also as an ink roller train.

The ink supply mechanism 9 can individually adjust the ink keys 26 to thereby supply variable amounts of ink to the ink key regions arranged across the predetermined feed direction of the paper sheet. Additionally, the ink supply mechanism 9 can increase or decrease the total amount of ink supply, depending on the ink supply count of the ink ductor roller 23. For example, stopping the reciprocating movement of the ink ductor roller 23 may cause no ink supply from the ink duct 21 to the ink rollers 22.

The ink transferred onto the printing plate surface by the ink supply mechanism 9 is transferred through the blanket cylinders 3 and 4 onto a printing paper sheet on the impression cylinder 5. The blanket cylinders 3 and 4 are selectively brought into and out of contact with the plate cylinders 1, 2 and the impression cylinder 5 by a cylinder throw-off mechanism 27 for placing the blanket cylinders 3 and 4 in a throw-off position.

<Description of Ink Amount and Printed Density>

Next, description will be given on a correlation between the amount of ink and the printed density in accordance with the ink presetting method of the present invention. An analysis of the process of ink transfer from the ink supply mechanism 9 to the paper sheet in a simulation has shown that, if the printed density of the paper sheet is held constant, the amount a of ink supplied from the ink duct 21 to the ink roller train and the amount b of ink consumed or transferred from the ink roller train to the printing plate surface are brought into balance, and the total amount of ink remaining on the ink roller train becomes substantially constant. This phenomenon will be described using the experimental results shown in FIGS. 6 through 10.

Figure 6:
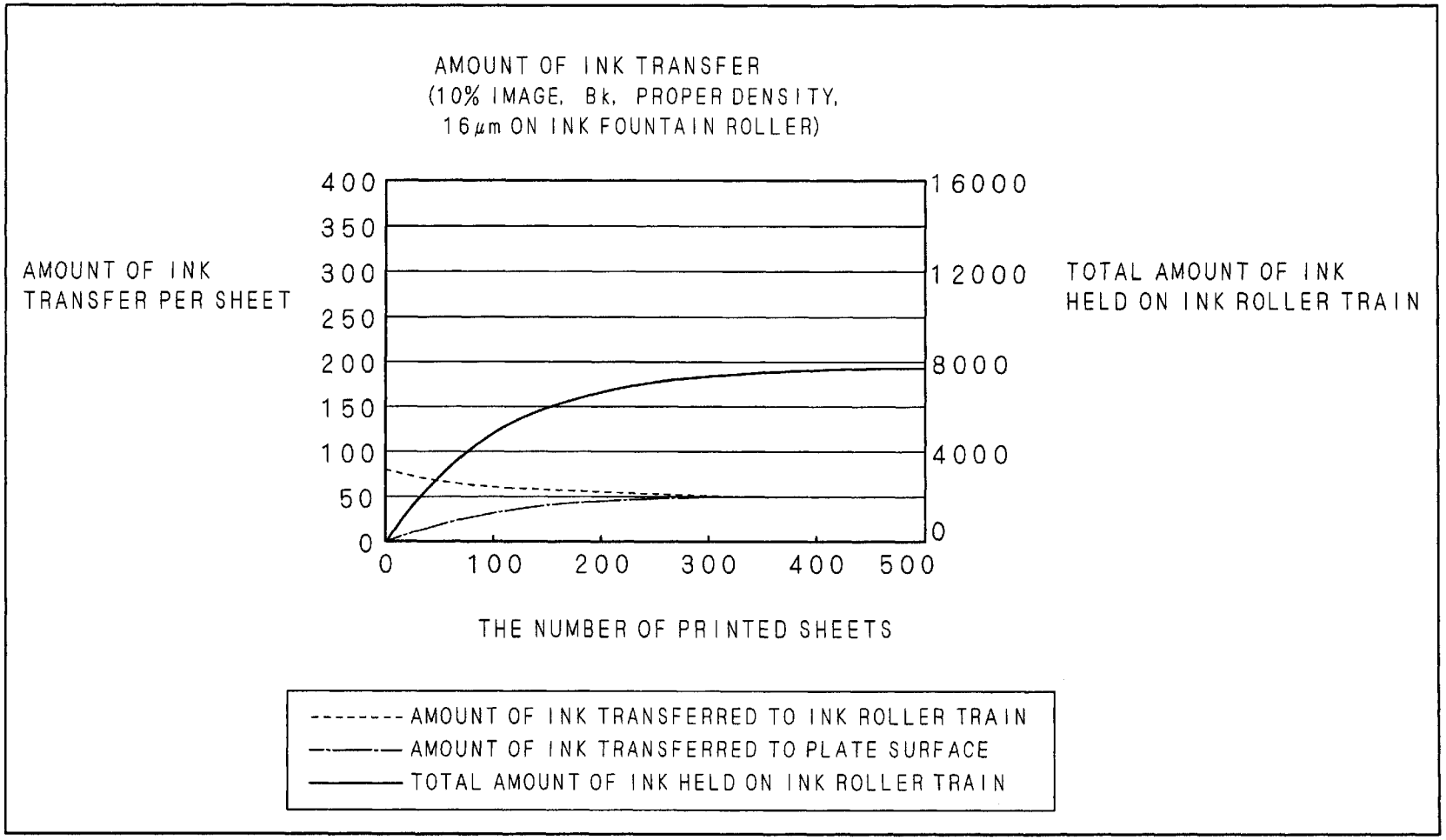
FIGS. 6 through 10 are graphs showing changes in the amount of ink transfer.
Figure 7:
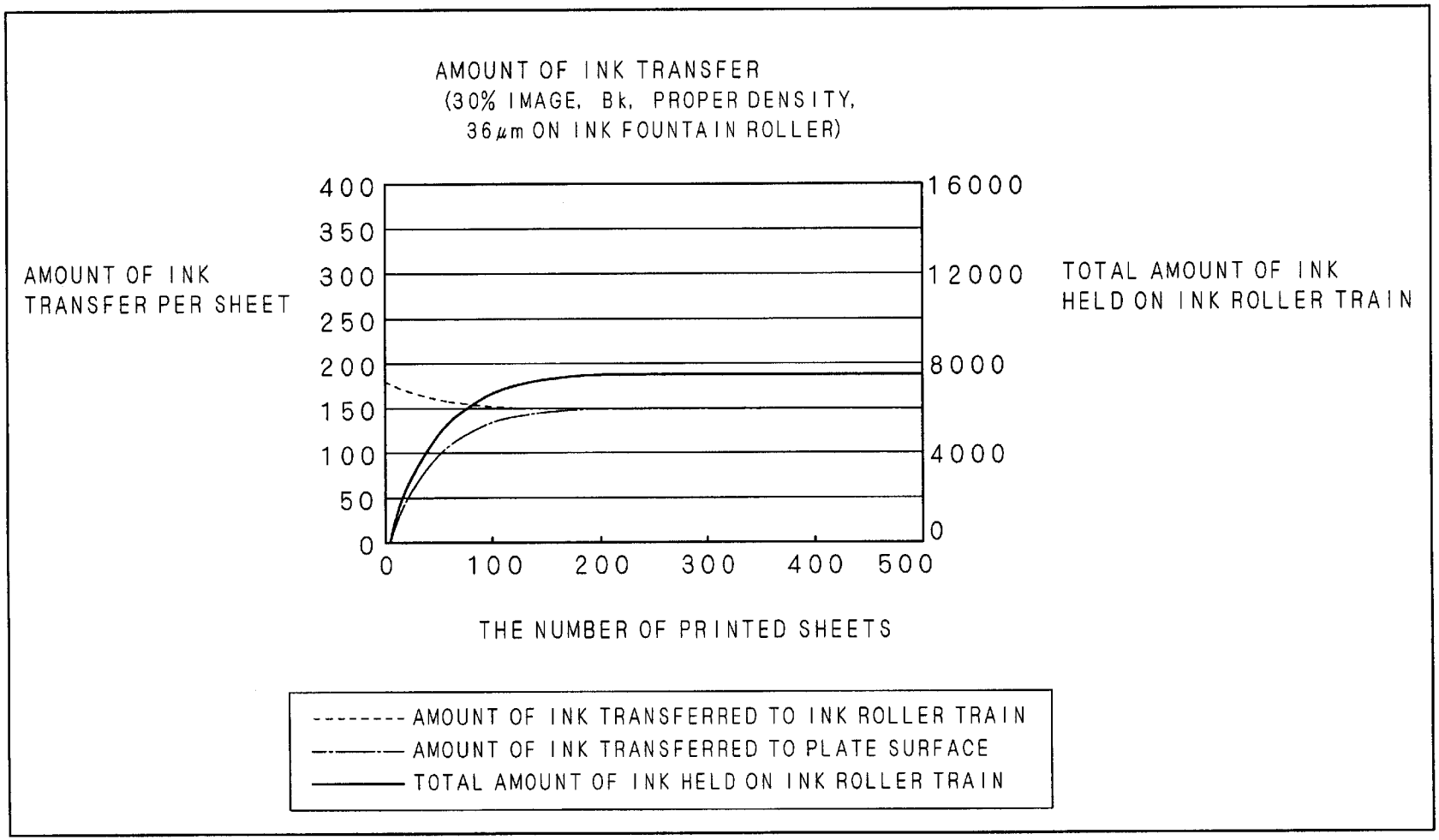
Figure 8:
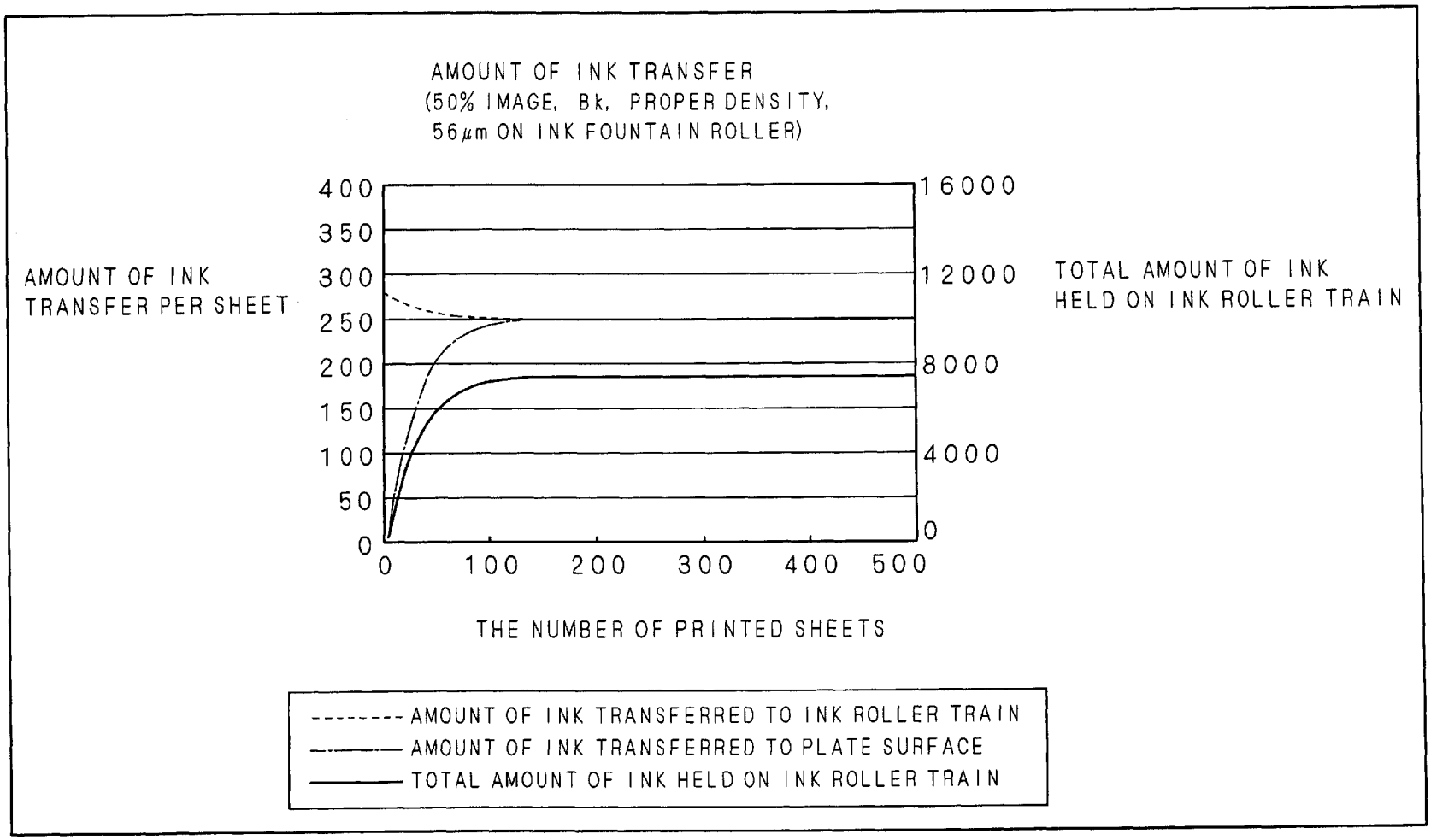

FIGS. 6 through 8 are graphs showing changes in the amounts of ink when printing is performed using different image areas of 10%, 30% and 50%, respectively, and the printed density is controlled to maintain a proper value. The amount of ink is expressed in terms of a cross-sectional area (1/1000 square mm) calculated by multiplying the ink thickness on the ink rollers by a roller circumference.

In FIGS. 6 through 8, the dotted lines indicate the amount A of ink transfer (the same as the amount a of ink supply) per paper sheet from the ink duct 21 to the ink roller train (along the left-hand vertical axis). The amount A of ink transfer to the ink roller train has a maximum value immediately after the beginning of printing. Since the amount of ink held on the ink roller train gradually increases, the amount A of ink transfer gradually decreases and becomes constant.

The dot-dash lines in FIGS. 6 through 8 indicate the amount B of ink transfer (the same as the amount b of ink consumption) per paper sheet from the ink roller train to the printing plate surface (along the left-hand vertical axis). The amount B of ink transfer to the printing plate surface equals zero at the beginning of printing. Then, the amount B of ink transfer increases each time the ink is supplied, and becomes constant.

The solid lines in FIGS. 6 through 8 indicate the total amount C of ink held on the ink roller train. The total amount C of ink (along the right-hand vertical axis) equals zero at the beginning of printing. The total amount C of ink increases each time the ink is supplied, and becomes constant. When the printed density is controlled at a constant value, the amount A of ink transfer and the amount B of ink transfer are brought into balance, and the total amount C of ink converges to a constant value. It will also be found from the graphs that the total amount C of ink has substantially the same value independently of the image area if the printed density is the same. That is, controlling the printed density at a constant value brings the amount of ink supply and the amount of ink consumption into balance to cause the total amount C of ink held on the ink roller train to be held substantially constant independently of the image area.

Figure 9:
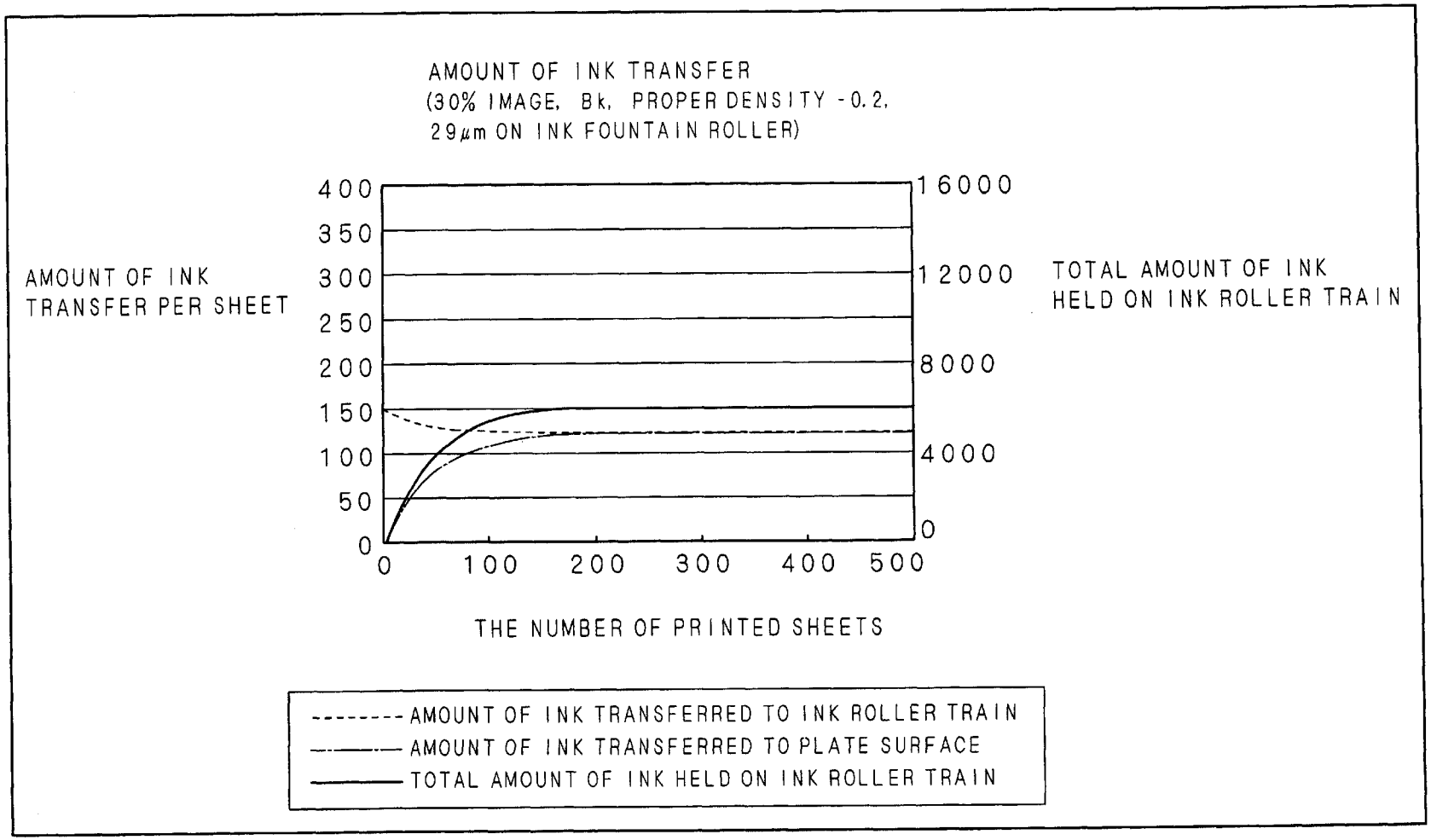
Figure 10:
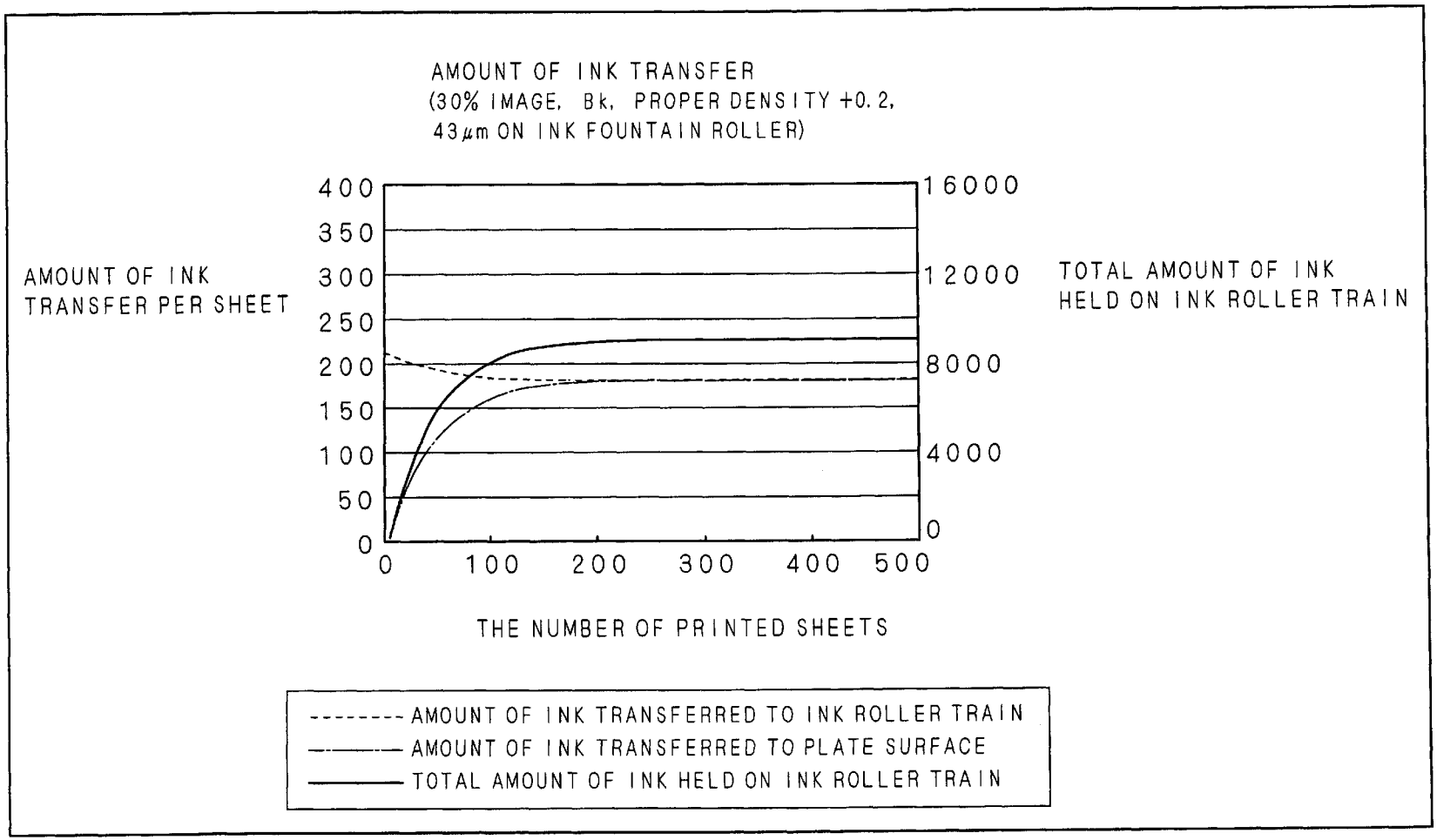

FIGS. 9 and 10 are graphs showing changes in the amounts of ink when printing is performed using the same image area of 30% and the printed density is controlled to maintain a proper density minus 0.2 and a proper density plus 0.2, respectively. The dotted lines, dot-dash lines and solid lines in FIGS. 9 and 10 indicate the same items as those in FIGS. 6 through 8. As shown in FIGS. 9 and 10, increasing or decreasing a target printed density changes the total amount C of ink held on the ink roller train when the total amount C becomes constant.

In the light of the above-mentioned characteristics, controlling the supply of ink so that the printed densities in all of the ink key regions are always the same causes a substantially constant amount of ink to remain on the ink rollers in the axial direction thereof, independently of the images in the ink key regions. A first characteristic of the present invention is to provide a substantially constant amount of ink remaining on the ink rollers by the use of the above-mentioned technique.

In the first preferred embodiment, the printed density to be adjusted is controlled depending on the measured density of the solid patches provided for each ink key region. Studies of the inventors of the present invention have shown that the printed density should be adjusted within a ±0.2 range, preferably within a ±0.1 range, more preferably within a ±0.05 range, around the target printed density. A printed density difference greater than the above causes a large change to occur in the amount of ink remaining on the ink roller train as shown in FIGS. 9 and 10, thereby making it difficult to preset ink. It is therefore necessary to make a precise adjustment within the above-mentioned density range.

The printed density is measured each time about five paper sheets are printed since it is better to make as real-time measurements as possible without delay in feedback control of ink supply. It is difficult for a conventional manual sampling inspection by an operator to meet such a requirement. Additionally, frequent sampling inspection is inconvenient because of the need to increase the number of sheets required to be printed. It is therefore desirable that a device for measuring the printed density is provided in the printing apparatus as in the first preferred embodiment.

As discussed above, the present invention precisely controls the printed density to provide a constant amount of ink held on the ink roller train. However, the amounts A and B of ink transferred, or supplied and consumed, for each paper sheet differ depending on the image area to be printed. The amounts of ink corresponding to the amounts A and B of ink transfer for each paper sheet are actually distributed with a predetermined inclination from an upstream roller toward a downstream roller in the ink roller train. Although the amount of ink corresponding to this inclination is very slight as compared with the total amount of ink held on the ink roller train, it will be considered in some cases that the total amount of ink held on the ink roller train is increased by the amount corresponding to the inclination even if the printed density is controlled at a predetermined value. It is therefore a second characteristic of the present invention to provide the step of decreasing the printed density at the end of printing so as to slightly decrease the amount of ink remaining on the ink roller train.

<Description of Ink Presetting Method>

Figure 3:
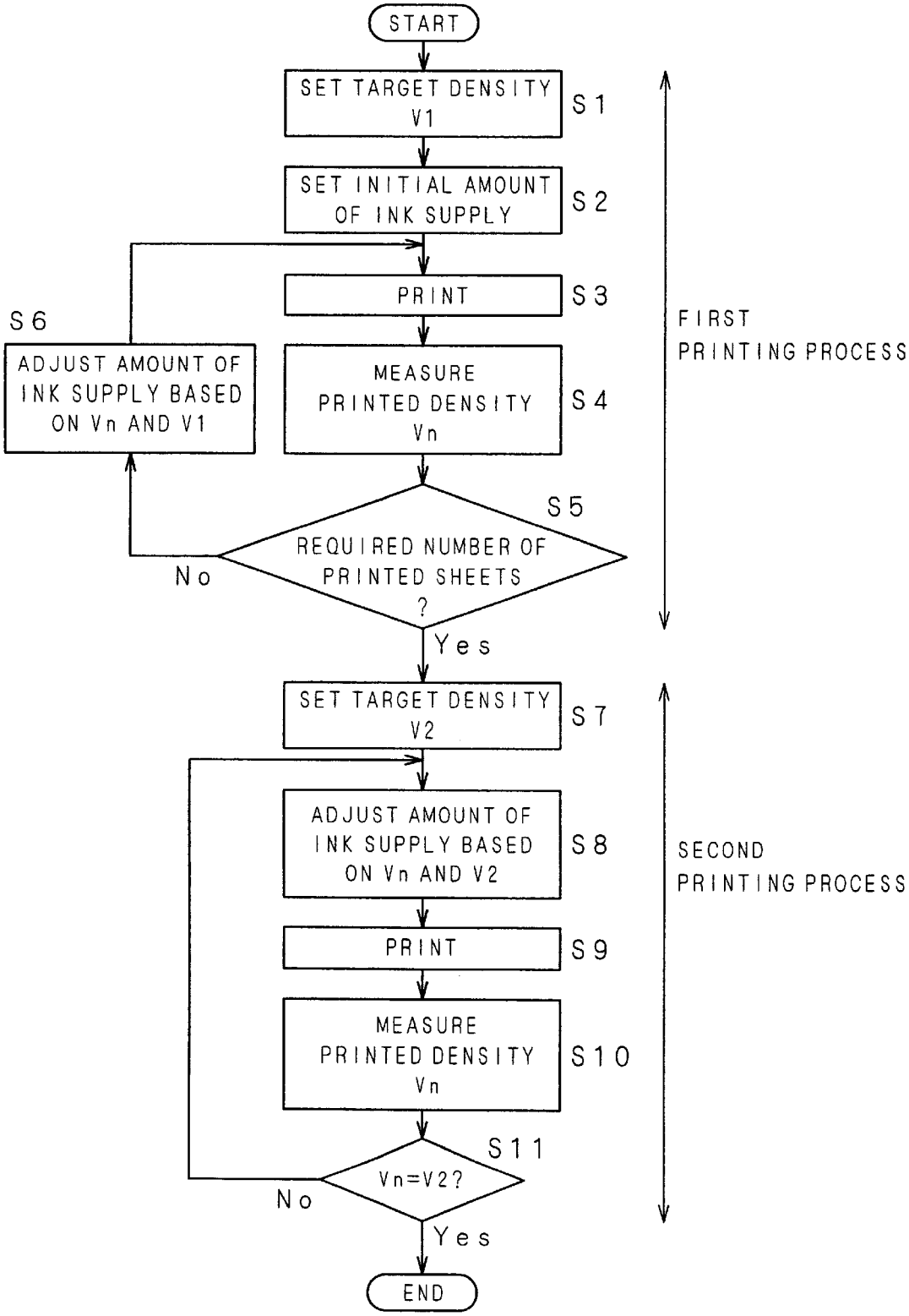
FIG. 3 is a flowchart showing the method of presetting ink according to a first preferred embodiment of the present invention.

Next, a procedure of the method of presetting ink according to the first preferred embodiment will be described with reference to FIGS. 3 through 5. FIG. 3 is a flowchart showing the method of presetting ink according to the first preferred embodiment.

Referring to FIG. 3, a target printed density V1 is set in Step S1. The target printed density V1 ranges from about 1.3 to about 1.8 depending on the printed color when typical coated paper, for example, is used, and has the same value in the predetermined feed direction of the sheet. In Step S2, the opening is adjusted for each ink key 26 depending on the area of an image to be printed. In Step S3, printing is started. Of course, the amounts of dampening water and ink may be suitably adjusted to perform test printing before the start of the actual printing.

In Step S4, the printed density Vn is measured for each color and for each ink key region on the paper sheet subjected to the printing process. This is carried out, as described above, by reading the solid patches of each color which are printed on the paper sheet by the image reader 16 and then converting the RGB values of the read image data into the YMCK densities.

In Step S5, a judgment is made as to whether or not the required number of printed paper sheets is reached. If printing has not yet been completed, the processing returns to Step S3 via Step S6. In Step S6, a comparison is made as to whether or not the measured printed density Vn is approximately equal to the target printed density V1. If there is a difference between the measured and target printed densities Vn and V1, the ink key opening is adjusted in accordance with the difference. In the first preferred embodiment, the measured printed density Vn may be within the range of V1 ±0.2.

The feedback control in Step S6 is established at desired intervals, that is, for every one through tens of printed sheets. If it is judged that the printed sheets are of stable and good quality, the number of printed sheets is counted. If it is judged in Step S5 that the required number of sheets have been printed, the processing proceeds to Step S7.

In Step S7, the target printed density is changed to V2. It has been experimentally found that the target printed density V2 may be set to satisfy $V1>V2\geqq(V1-0.2)$. Preferably, the target printed density V2 is set at a value lower by 0.1 or 0.2 than V1. In Step S8, the amount of ink supply is adjusted in accordance with the new setting of the target printed density V2. In this step, although the individual ink key openings may be readjusted, the speed of rotation of the ink fountain roller 25 or the ink supply count of the ink ductor roller 23 may be adjusted for uniform density reduction in the all of the regions. Of course, these techniques of adjustments may be used in combination.

Printing is carried out in Step S9, and the printed density is measured in Step S10. In Step S11, a comparison is made as to whether or not the measured printed density Vn is approximately equal to the target printed density V2. If the measured printed density Vn is approximately equal to the target printed density V2, the flow of processing is completed; otherwise, the processing returns to Step S8.

In this method of presetting ink, a normal first printing process in Steps S1 through S6 is performed in which the printed density of each ink key region is made approximately equal to the target printed density V1. This provides a substantially constant amount of ink held on the ink roller train at the end of the first printing process. Next, a second printing process in Steps S7 through S11 is performed, with the printed density decreased from V1 to V2. Thus, the amount of ink held on the ink roller train at the end of the second printing process is slightly lower than that in the first printing process.

This method causes a small amount of ink having a constant thickness in each ink key region to remain on the ink roller train at the end of the printing, to allow early start of printing in the next operation because of a stable ink distribution. Additionally, in this method, the printing density control is effected previously in the first printing process to facilitate the adjustments in the second printing process, thereby requiring a very small number of printed sheets to be consumed. Furthermore, the sheets printed in the second printing process are slightly lower in density than the sheets printed in the first printing process, and may be used as proper printed sheets if they are judged to be at a permissible level in quality.

The method of presetting ink according to the first preferred embodiment uses the paper sheets in the second printing process, which creates the likelihood of production of the spoilage. However, the decrease in printed density is achieved by transfer of ink onto the plate cylinders and the blanket cylinders without the use of the paper sheets. FIG. 4 is a flowchart showing the method of presetting ink according to a second preferred embodiment of the present invention, which is based on such a principle.

Figure 4:
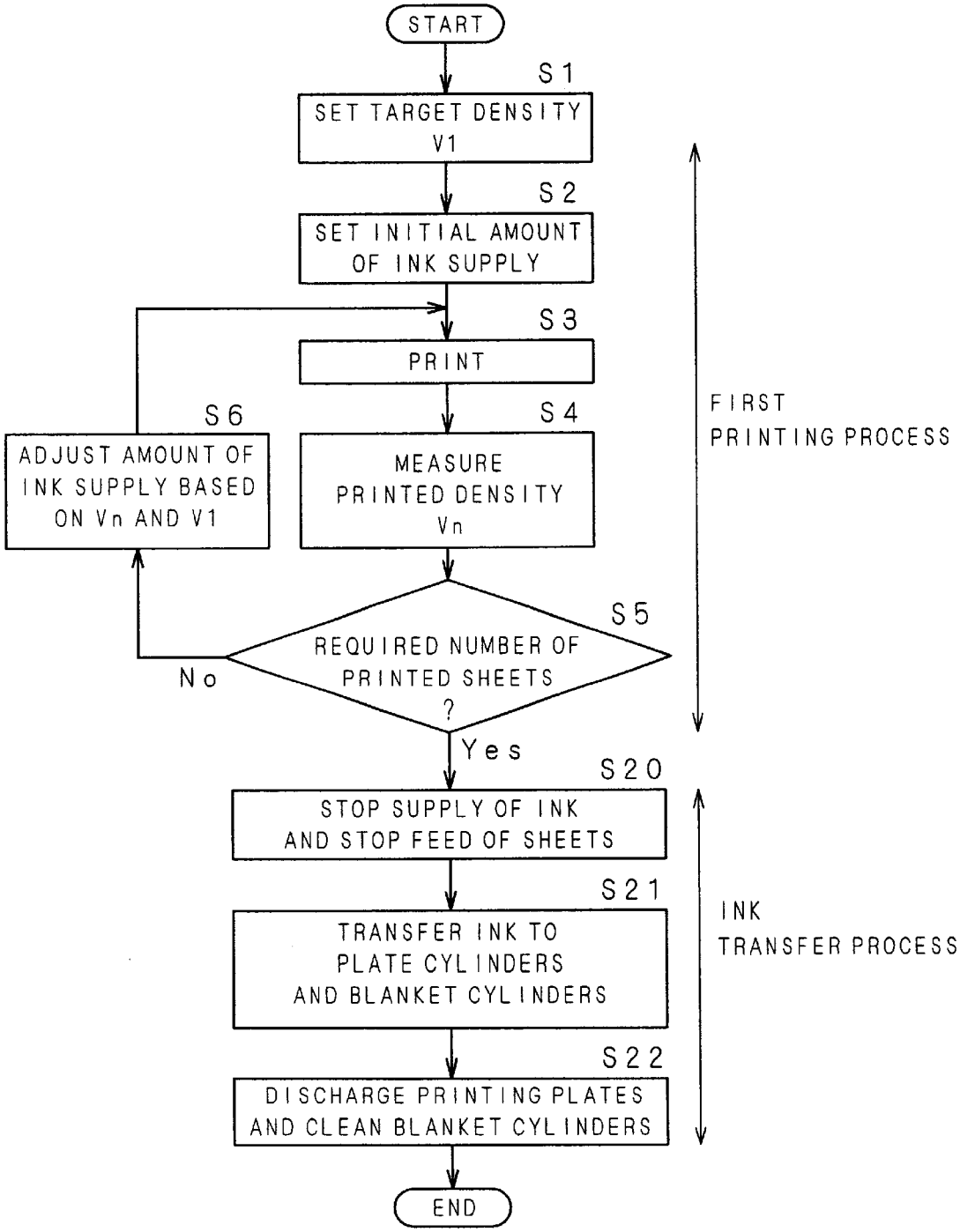
FIG. 4 is a flowchart showing the method of presetting ink according to a second preferred embodiment of the present invention.
Figure 5:
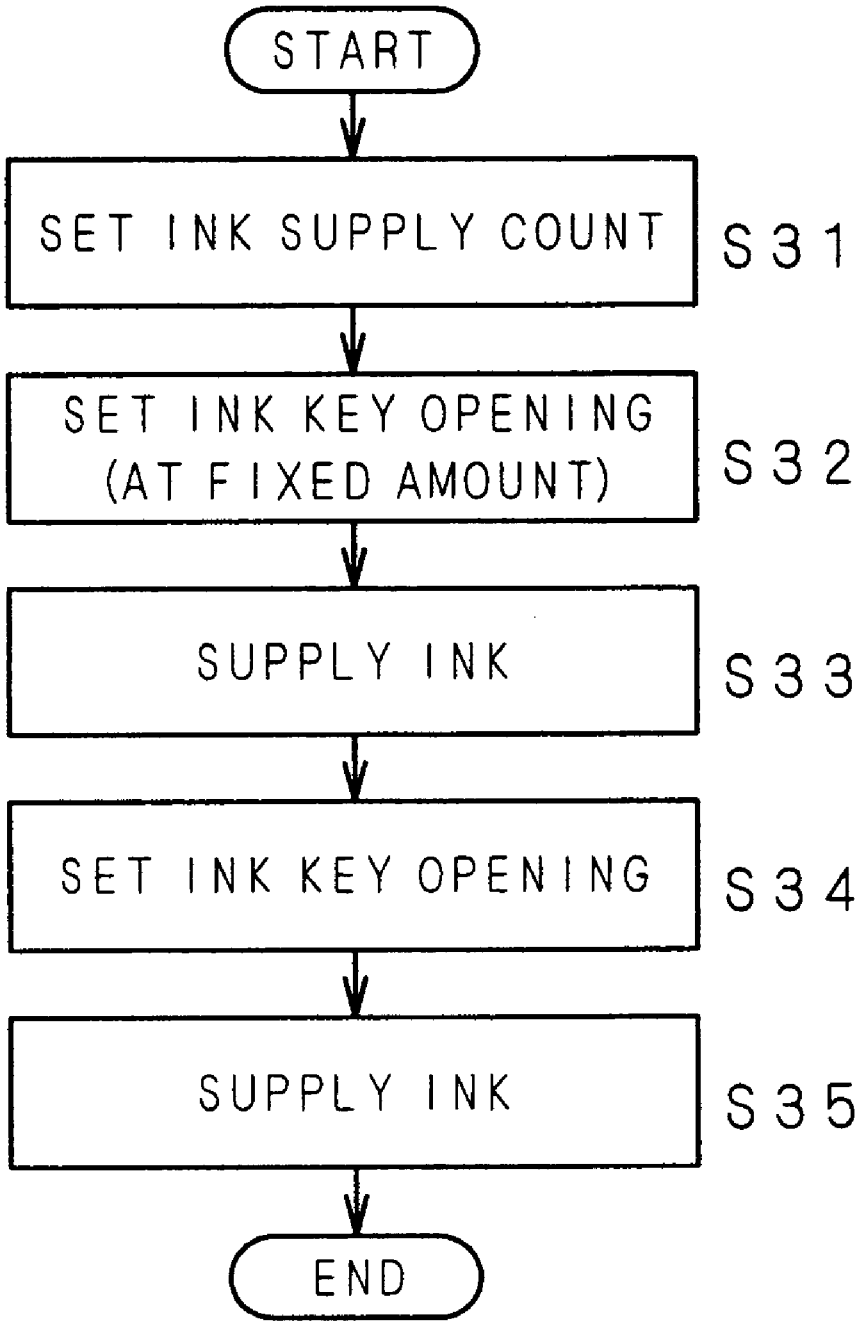
FIG. 5 is a flowchart showing a new ink supply procedure after the ink on ink rollers is reduced to a fixed amount.

Steps S1 through S6 shown in FIG. 4 are identical with those of the first preferred embodiment, and are not particularly described. According to the second preferred embodiment, the supply of ink and the feed of paper sheets are stopped in Step S20. Stopping the supply of ink is achieved by stopping the ink supply operation of the ink ductor roller 23. As the feed of paper sheets is stopped, the blanket cylinders 3 and 4 are moved out of engagement with the impression cylinder 5 into the throw-off position.

In Step S21, the plate cylinders 1 and 2 are rotated, with the form roller 24 in contact with the printing plate surfaces, to transfer the ink from the ink roller train onto the printing plate surfaces. An experiment shows that rotating each of the plate cylinders 1 and 2 about three turns produces an effect approximately equivalent to the decrease in printed density provided in the first preferred embodiment, that is, the effect of approximately −0.1 in terms of printed density. After the completion of this ink transfer process, the form roller 24 may be brought out of contact with the plate cylinders 1 and 2, and thereafter the plate cylinders 1 and 2 may be rotated in contact with the blanket cylinders 3 and 4. In this case, the ink transferred to the plate cylinders 1 and 2 are distributed also onto the blanket cylinders 3 and 4.

It has been found that placing the blanket cylinders 3 and 4 in contact with the plate cylinders 1 and 2 during the above-mentioned ink transfer process, rather than after the ink transfer process, increases the amount of ink transfer to produce an effect of about −0.2 in terms of printed density.

In Step S22, the printing plates with ink transferred thereon are discharged. The cleaning device 17 cleans the blanket cylinders 3 and 4 with ink transferred thereon. If the application of ink presents a problem during the discharge of the printing plates, the printing plates may be cleaned and then discharged. As the simplest example, placing the plate cylinders 1 and 2 in contact with the blanket cylinders 3 and 4 during the cleaning of the blanket cylinders 3 and 4 by the cleaning device 17 allows the printing plates to be indirectly cleaned. Since a low degree of cleaning of the printing plates is sufficient, the cleaning may be performed simultaneously in the first half of the process of cleaning the blanket cylinders 3 and 4.

The method of presetting ink according to the first and second preferred embodiments distributes the ink remaining prior to the next printing operation uniformly by the ink roller train to decrease the amount of ink. For the next printing operation, ink must be actually supplied in accordance with a new image area distribution. Such a method will be described with reference to the flowchart of FIG. 5.

The amount of ink to be newly supplied is set in Step S31. It is assumed that the adjustment of the amount of ink in this step is made using the ink supply count of the ink ductor roller 23. For example, in the first preferred embodiment, the ink supply count in Steps S33 and S35 to be described below is set in accordance with a printed density difference (V1−V2). In the second preferred embodiment, the ink supply count in Steps S33 and S35 to be described below is set in accordance with the amount of ink transfer to the printing plates and the blanket cylinders 3 and 4 which is previously experimentally known.

In Step S32, the opening of all ink keys is set uniformly, for example, at about 75%. In Step S33, ink is supplied the number of times corresponding to the ink supply count set in Step S31 in this condition. In this case, ink is supplied under conditions such that the opening is 75% and the ink supply count is about six, when the printed density is decreased by 0.1 in the first preferred embodiment.

Next, in Step S34, the opening of the ink keys is adjusted in accordance with the image area in the next printing operation. In this condition, ink is supplied in Step S35. The ink supply count in this step is about three. Such a procedure can adjust the uniformly decreased amount of ink to an amount required for the next printing operation after the first and second preferred embodiments. Although the above-mentioned adjustment of the amount of ink is mainly based on the ink supply count of the ink ductor roller 23, other parameters, e.g. the amount of rotation of the ink fountain roller, may be adjusted.

The method of presetting ink according to the above preferred embodiments may be used for typical offset printing apparatuses having no prepress mechanisms and dry lithographic presses employing no dampening water.

Figure 11:
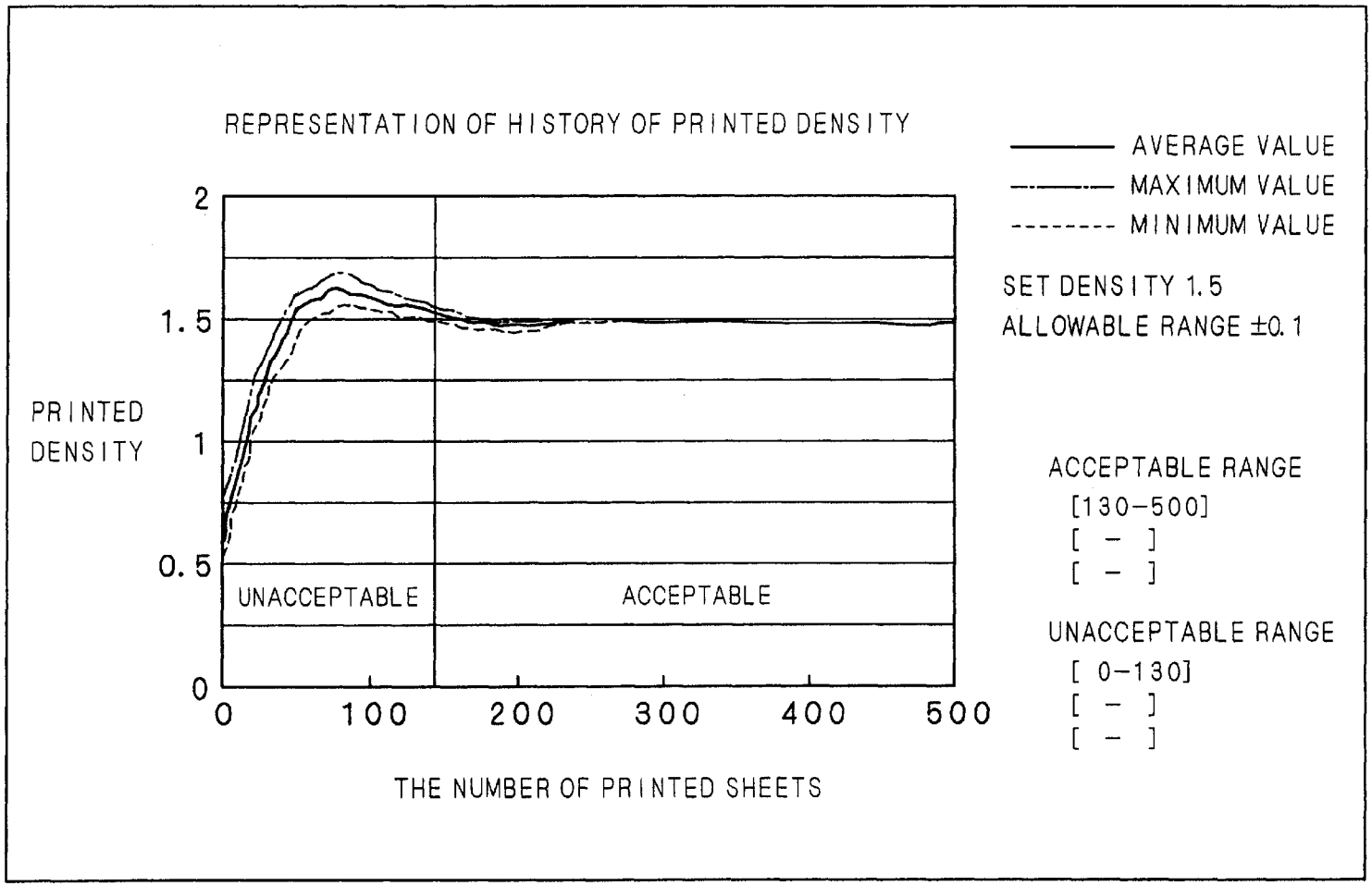
FIG. 11 is a graph showing a history of a printed density.

Although the device for measuring the printed density may be provided outside the printing apparatus 100, the measuring device is preferably provided in the printing apparatus 100 for the above-mentioned reasons so that the real-time feedback control is effected. This presents an additional advantage in being capable of easily managing a density history for the printed paper sheets. For instance, FIG. 11 is a graph showing the history of the printed density for a predetermined color and for a predetermined ink key region. When the measured printed density Vn is recorded for every predetermined number of printed sheets or at every predetermined time interval, such data may be displayed or printed out and may be used as management data about the printed sheets.

It is preferable that the printed density is measured based on the solid patches provided in each ink key region. However, the printed density of a specific portion of a previously set image may be measured.

While the invention has been described in detail, the foregoing description is in all aspects illustrative and not restrictive. It is understood that numerous other modifications and variations can be devised without departing from the scope of the invention.

What is claimed is:

1. A method of presetting ink in a printing apparatus, said apparatus comprising an ink supply mechanism capable of variably supplying ink, and an ink transfer mechanism capable of receiving said ink from said ink supply mechanism and transferring said ink onto a plate cylinder provided to print an ink image on a printing sheet being fed in a predetermined feeding direction, said method comprising the steps of:

a) setting a first target density for a plurality of ink key regions defined on each printing sheet along said feeding direction;

b) performing a first printing operation under a first feedback control of said ink supply mechanism using said first target density;

c) performing a second printing operation under a second feedback control of said ink supply mechanism using a second target density lower than said first target density after a required number of sheets are printed in said step b); and d) when a printed sheet has a density lowered to said second target density, judging that the amount of ink remaining on said ink transfer mechanism is equal to an amount required to restart said printing apparatus for a next printing operation, thereby to stop said second printing operation.

2. The method according to claim 1, wherein the step b) comprises the steps of measuring respective densities on said plurality of ink key regions to obtain first values of measured density, and adjusting respective ink keys of said ink supply mechanism in response to said first values of said measured density.

3. The method according to claim 2, wherein the step c) comprises the steps of measuring respective densities on said plurality of ink key regions to obtain second values of measured density, and adjusting said respective ink keys of said ink supply mechanism in response to said second values of said measured density.

4. The method according to claim 3, wherein said respective densities on said plurality of ink key regions are measured with a density detector provided in said printing apparatus.

5. The method according to claim 4, wherein said respective ink keys of said ink supply mechanism are adjusted so that said second values of measured density are within a ±0.2 range around said second target density in the step c).

6. The method according to claim 5, wherein said second target density value is so set as to satisfy the condition $V1>V2\geqq(V1-0.2)$, where V1 is said first target density, and

V2 is said second target density.

7. The method according to claim 1, wherein data values of said measured density are periodically sampled and stored in association with a sheet number or time each corresponding to said data values of said measured density to visually output a history of said data values of said measured density.

8. The method according to claim 1, further comprising the steps of:

e) setting a fixed ink key opening for each of said ink key regions to add a constant amount of ink to said ink transfer mechanism; and f) setting an ink key opening depending upon a next image-to-be-printed for each of said ink key regions to add ink to said ink transfer mechanism, said steps e) and t) being performed after said printing apparatus is stopped and before said restart of said printing apparatus for said next printing operation.

9. A method of presetting ink in a printing apparatus, said apparatus comprising an ink supply mechanism capable of variably supplying ink, and an ink transfer mechanism capable of receiving said ink from said ink supply mechanism and transferring said ink onto a plate cylinder provided to print an ink image on a printing sheet being fed in a predetermined feeding direction, a blanket cylinder contacting said plate cylinder, and a density detector for measuring a density of an image printed on a printing sheet, said method comprising the steps of:

a) setting a target density for a plurality of ink key regions defined on each printing sheet along said feeding direction;

b) performing a printing operation under a feedback control of said ink supply mechanism using said target density, comprising the steps of:

b-1) measuring respective densities on said plurality of ink key regions to obtain values of measured density, and b-2) adjusting each ink key of said ink supply mechanism so that said values of measured density are within a ±0.2 range around said target density;

c) changing said printing apparatus to an intermediate state, said intermediate state being defined by conditions that transfer of said ink from said ink supply mechanism to said ink transfer mechanism is stopped and said printing operation is also stopped;

d) transferring residual ink on said ink transfer mechanism to said plate cylinder in said intermediate state, comprising the steps of:

d-1) rotating said plate cylinder and said blanket cylinder at least one turn to transfer ink to said blanket cylinder as well as to said plate cylinder; and e) stopping said printing apparatus, wherein data values of said measured density are periodically sampled and stored in association with a sheet number or time each corresponding to said data values of said measured density to visually output a history of said data values of said measured density.

10. The method according to claim 9, further comprising the steps of:

e) setting a fixed ink key opening for each of said ink key regions to add a constant amount of ink to said ink transfer mechanism; and f) setting an ink key opening depending upon a next image-to-be-printed for each of said ink key regions to add ink to said ink transfer mechanism, said steps e) and f) being performed after said printing apparatus is stopped and before restart of said printing apparatus for a next printing operation.

* * * * *